US011380458B2

(12) United States Patent
Sakamoto et al.

(10) Patent No.: US 11,380,458 B2
(45) Date of Patent: Jul. 5, 2022

(54) COVERED ELECTRICAL WIRE, TERMINAL-EQUIPPED ELECTRICAL WIRE, COPPER ALLOY WIRE, AND COPPER ALLOY STRANDED WIRE

(71) Applicants: Sumitomo Electric Industries, Ltd., Osaka (JP); Sumitomo Wiring Systems, Ltd., Yokkaichi (JP); AutoNetworks Technologies, Ltd., Yokkaichi (JP)

(72) Inventors: Kei Sakamoto, Osaka (JP); Akiko Inoue, Osaka (JP); Tetsuya Kuwabara, Osaka (JP); Yusuke Oshima, Osaka (JP); Minoru Nakamoto, Osaka (JP); Kazuhiro Nanjo, Osaka (JP); Taichiro Nishikawa, Osaka (JP); Yoshihiro Nakai, Osaka (JP); Kazuhiro Goto, Osaka (JP); Ryo Toyoshima, Osaka (JP); Yasuyuki Otsuka, Yokkaichi (JP); Fumitoshi Imasato, Yokkaichi (JP); Hiroyuki Kobayashi, Yokkaichi (JP)

(73) Assignees: Sumitomo Electric Industries, Ltd., Osaka (JP); Sumitomo Wiring Systems, Ltd., Yokkaichi (JP); AutoNetworks Technologies, Ltd., Yokkaichi (JP)

( * ) Notice: Subject to any disclaimer, the term of this patent is extended or adjusted under 35 U.S.C. 154(b) by 0 days.

(21) Appl. No.: 17/269,895

(22) PCT Filed: Jun. 13, 2019

(86) PCT No.: PCT/JP2019/023469
§ 371 (c)(1),
(2) Date: Feb. 19, 2021

(87) PCT Pub. No.: WO2020/039712
PCT Pub. Date: Feb. 27, 2020

(65) Prior Publication Data
US 2021/0183533 A1 Jun. 17, 2021

(30) Foreign Application Priority Data
Aug. 21, 2018 (JP) ..... JP2018-154530

(51) Int. Cl.
*H01B 7/18* (2006.01)
*H01B 1/02* (2006.01)
(Continued)

(52) U.S. Cl.
CPC ..... *H01B 1/026* (2013.01); *C22C 9/02* (2013.01); *C22C 9/06* (2013.01); *H01B 7/18* (2013.01)

(58) Field of Classification Search
CPC ..... H01B 1/02–1/08; H01B 7/0036; H01B 13/0036; H01B 13/0016; H01R 4/185;
(Continued)

(56) References Cited

U.S. PATENT DOCUMENTS

2008/0314612 A1* 12/2008 Takahashi ..... H01B 1/026 148/685
2015/0371726 A1 12/2015 Inoue et al.
(Continued)

FOREIGN PATENT DOCUMENTS

JP 2013-216973 A * 10/2013 ..... C22C 9/00
JP 2014-156617 A 8/2014
(Continued)

*Primary Examiner* — William H. Mayo, III
(74) *Attorney, Agent, or Firm* — Baker Botts L.L.P.; Michael A. Sartori

(57) ABSTRACT

A covered electrical wire comprises a conductor and an insulating covering layer provided outside the conductor, the conductor being a stranded wire composed of a plurality of copper alloy wires composed of a copper alloy and twisted
(Continued)

together, and has a wire diameter of 0.5 mm or less, the copper alloy containing Ni, or Ni and Fe in an amount of 0.1% by mass or more and 1.6% by mass or less in total, and P in an amount of 0.05% by mass or more and 0.7% by mass or less, with a balance being Cu and impurities, in the copper alloy, a ratio of precipitation of P to solid solution of P being 1.1 or more.

16 Claims, 3 Drawing Sheets

(51) Int. Cl.
*C22C 9/02* (2006.01)
*C22C 9/06* (2006.01)

(58) Field of Classification Search
CPC .. H01R 43/00; C22C 1/08; C22C 9/00; C22C 9/04; C22C 9/06; C22C 9/10; H02G 3/02
USPC ..... 174/74 R, 78, 68.1; 420/485, 481; 29/825
See application file for complete search history.

(56) References Cited

U.S. PATENT DOCUMENTS

| | | | | |
|---|---|---|---|---|
| 2016/0284437 | A1* | 9/2016 | Inoue | H01B 1/026 |
| 2019/0341164 | A1 | 11/2019 | Sakamoto et al. | |
| 2019/0355489 | A1 | 11/2019 | Sakamoto et al. | |

FOREIGN PATENT DOCUMENTS

| | | | | |
|---|---|---|---|---|
| JP | 2015-086452 A | * | 5/2015 | C22C 9/04 |
| JP | 2018-077941 A | | 5/2018 | |
| WO | 2018/083836 A1 | | 5/2018 | |

* cited by examiner

COVERED ELECTRICAL WIRE, TERMINAL-EQUIPPED ELECTRICAL WIRE, COPPER ALLOY WIRE, AND COPPER ALLOY STRANDED WIRE

TECHNICAL FIELD

The present disclosure relates to a covered electrical wire, a terminal-equipped electrical wire, a copper alloy wire, and a copper alloy stranded wire.

The present application claims priority based on Japanese patent application No. 2018-154530 dated Aug. 21, 2018, and incorporates all the contents described in the above Japanese application.

BACKGROUND ART

Conventionally, a wire harness composed of a plurality of terminal-equipped electrical wires bundled together is used for a wiring structure of an automobile, an industrial robot or the like. A terminal-equipped electrical wire is an electrical wire having a terminal such as a crimp terminal attached to a conductor exposed at an end of the electrical wire through an insulating cover layer. Typically, each terminal is inserted into one of terminal holes provided in a connector housing, and is mechanically connected to the connector housing. The electrical wire is connected to the body of a device via the connector housing. Such connector housings may be connected together to thus connect electrical wires together. Copper or a similar, copper-based material is mainly used as a constituent material of the conductor (for example, see PTLs 1 and 2).

CITATION LIST

Patent Literature

PTL 1: Japanese Patent Laying-Open No. 2014-156617
PTL 2: Japanese Patent Laying-Open No. 2018-77941

SUMMARY OF INVENTION

According to the present disclosure, a covered electrical wire is a covered electrical wire comprising a conductor and an insulating covering layer provided outside the conductor, the conductor being a stranded wire composed of a plurality of copper alloy wires composed of a copper alloy and twisted together, and having a wire diameter of 0.5 mm or less, the copper alloy containing Ni, or Ni and Fe in an amount of 0.1% by mass or more and 1.6% by mass or less in total, and P in an amount of 0.05% by mass or more and 0.7% by mass or less, with a balance being Cu and impurities, in the copper alloy, a ratio of precipitation of P to solid solution of P being 1.1 or more.

According to the present disclosure, a terminal-equipped electrical wire comprises: the presently disclosed covered electrical wire; and a terminal attached to an end of the covered electrical wire.

According to the present disclosure, a copper alloy wire is composed of a copper alloy that contains Ni, or Ni and Fe in an amount of 0.1% by mass or more and 1.6% by mass or less in total, and P in an amount of 0.05% by mass or more and 0.7% by mass or less, with a balance being Cu and impurities, in the copper alloy, a ratio of precipitation of P to solid solution of P being 1.1 or more, and has a wire diameter of 0.5 mm or less.

According to the present disclosure, a copper alloy stranded wire is formed of a plurality of copper alloy wires, each as presently disclosed, twisted together.

DETAILED DESCRIPTION

Figure 1:
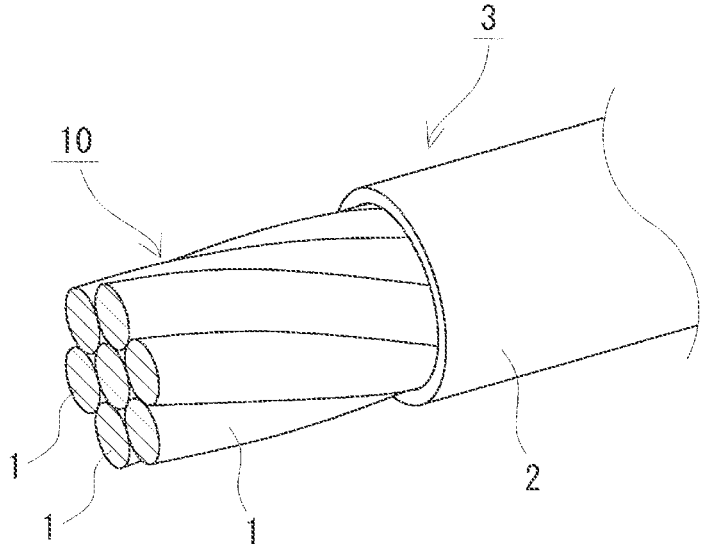
FIG. 1 is a schematic perspective view of a covered electrical wire according to an embodiment.

[Problem to Be Solved By the Present Disclosure]

There is a demand for an electrical wire which is excellent in conductivity and strength and also excellent in impact resistance. In particular, there is a demand for an electrical wire which is resistant to fracture against impact even when the electrical wire has a conductor composed of a thin copper alloy wire.

In recent years, as automobiles are increasingly enhanced in performance and function, more electric devices and control devices of a variety of types are mounted on the automobiles, and accordingly, more electrical wires tend to be used for these devices. This also tends to increase the electrical wires in weight. On the other hand, for preservation of environment, it is desirable to reduce electrical wires in weight for the purpose of improving fuel economy of automobiles. Although a wire member composed of a copper-based material as described in PTLs 1 and 2 easily has high conductivity, it easily has a large weight. For example, if a thin copper alloy wire having a wire diameter of 0.5 mm or less is used for a conductor, it is expected to achieve high strength through work hardening, and weight reduction by small diameter. However, such a thin copper alloy wire having a wire diameter of 0.5 mm or less as described above has a small cross section and is hence easily reduced in impact resistance, and is accordingly, fracturable when it receives an impact. Accordingly, there is a demand for a copper alloy wire which is excellent in impact resistance even when it is thin as described above.

An electrical wire used with a terminal such as a crimp terminal attached thereto as described above has its conductor compressed at a terminal attachment portion, which has a cross section smaller in area than that of the remaining portion of the conductor (hereinafter also referred to as the main wire portion). Accordingly, the terminal attachment portion of the conductor tends to be a portion fracturable when it receives an impact. Therefore, there is a demand for even such a thin copper alloy wire described above to have a terminal attachment portion and a vicinity thereof resistant to fracture when it receives an impact, that is, to be also excellent in impact resistance in a state with a terminal attached thereto.

Furthermore, when electrical wires applied to automobiles or the like are routed therein or connected to a connector housing, they may be pulled, bent or twisted, or they may receive vibration in use. Electrical wires applied to robots or the like may be bent or twisted in use. An electrical wire which is resistant to fracture when repeatedly bent or twisted and thus has excellent fatigue resistance, an electrical wire which is excellent in fixing a terminal such as a crimp terminal, and the like are more preferable.

It is an object of the present disclosure to provide a covered electrical wire, a terminal-equipped electrical wire, a copper alloy wire, and a copper alloy stranded wire that are excellent in conductivity and strength, and in addition, also excellent in impact resistance.

[Advantageous Effect of the Present Disclosure]

The presently disclosed covered electrical wire, terminal-equipped electrical wire, copper alloy wire, and copper alloy stranded wire are excellent in conductivity and strength, and in addition, also excellent in impact resistance.

[Description of Embodiments of the Present Disclosure]

Initially, the contents of the embodiments of the present disclosure will be enumerated.

(1) The presently disclosed covered electrical wire is a covered electrical wire comprising a conductor and an insulating covering layer provided outside the conductor, the conductor being a stranded wire composed of a plurality of copper alloy wires composed of a copper alloy and twisted together, and having a wire diameter of 0.5 mm or less, the copper alloy containing Ni, or Ni and Fe in an amount of 0.1% by mass or more and 1.6% by mass or less in total, and P in an amount of 0.05% by mass or more and 0.7% by mass or less, with a balance being Cu and impurities, in the copper alloy, a ratio of precipitation of P to solid solution of P being 1.1 or more.

The above-described stranded wire includes a plurality of copper alloy wires simply twisted together and in addition, such wires twisted together and subsequently compression-molded, i.e., a so-called compressed stranded wire. This also applies to a copper alloy stranded wire according to item (12) described hereinafter. A typical stranding method is concentric stranding.

When the copper alloy wire is a round wire its diameter is defined as a wire diameter, whereas when the copper alloy wire is a shaped wire having a transverse cross section other than a circle, the diameter of a circle having an area equivalent to that of the transverse cross section is defined as a wire diameter.

Since the presently disclosed covered electrical wire comprises a wire member composed of a copper based material and having a small diameter (or a copper alloy wire) for a conductor, the covered electrical wire is excellent in conductivity and strength, and in addition, light in weight. The copper alloy wire is composed of a copper alloy of a specific composition including Ni, or Ni and Fe, and P in a specific range. As will be described below, the presently disclosed covered electrical wire is excellent in conductivity and strength and in addition, also excellent in impact resistance. In the copper alloy described above, Ni, Fe and P are representatively present in a matrix phase (Cu) as precipitates and crystallites including P, such as $Ni_2P$ and $Fe_2P$, and the elements effectively enhance strength through enhanced precipitation and effectively maintain high conductivity by reduction of solid solution in Cu. The copper alloy wire composed of the copper alloy has high strength due to precipitation enhanced by these elements. Accordingly, even when the copper alloy wire undergoes a heat treatment and is thus further elongated, it has high strength, and also has high toughness and is thus also excellent in impact resistance. The presently disclosed covered electrical wire, copper alloy stranded wire constituting a conductor of the covered electrical wire, and copper alloy wire serving as each elemental wire forming the copper alloy stranded wire as described above can be said to have high conductivity, high strength and high toughness in a good balance.

Further, the presently disclosed covered electrical wire comprises as a conductor a stranded wire of a copper alloy having high strength and high toughness as described above. When a covered electrical wire comprising a stranded wire as a conductor is compared with an electrical wire comprising as a conductor a solid wire equal in cross section to the stranded wire, the former's conductor (or the stranded wire) as a whole tends to be better in mechanical properties such as bendability and twistability. The presently disclosed covered electrical wire is thus excellent in fatigue resistance. Furthermore, the above stranded wire and copper alloy wire tend to be easily work-hardened when subjected to plastic working accompanied by reduction in cross section, such as compression-working. Therefore, when the presently disclosed covered electrical wire has a terminal such as a crimp terminal attached thereto, the covered electrical wire can be work-hardened to firmly fix the terminal thereto. The presently disclosed covered electrical wire is thus also excellent in fixing the terminal. The presently disclosed covered electrical wire can thus be work-hardened to allow a conductor (or stranded wire) to have a terminal-connected portion enhanced in strength and be thus resistant to fracture at the terminal-connected portion when it receives an impact. The presently disclosed covered electrical wire is thus also excellent in impact resistance in a state with a terminal attached thereto.

Further, a ratio of precipitation of P to solid solution of P in the copper alloy is 1.1 or more, and a ratio of P present in the copper alloy in a precipitated state is relatively large, that is, a ratio of P present in the copper alloy in a state of a solid solution is relatively small. Thus, enhanced precipitation allows a strength enhancement effect to be satisfactorily obtained, and also suppresses solid solution of P in the matrix phase and hence reduction in conductivity to effectively maintain high conductivity satisfactorily. A "ratio of precipitation of P to solid solution of P" means a ratio of a proportion of P present in a precipitated state (a proportion of precipitation) to a proportion P present in a state of a solid solution (a proportion of solid solution). How the ratio of precipitation of P to solid solution of P is measured will be described hereinafter.

(2) An example of the presently disclosed covered electrical wire includes an embodiment in which the copper alloy includes Sn in an amount of 0.05% by mass or more and 0.7% by mass or less.

The above embodiment that contains Sn in a specific range enhances solid solution of Sn and thereby obtains a strength enhancement effect, and is thus more excellent in strength.

(3) An example of the presently disclosed covered electrical wire includes an embodiment in which a ratio in mass of a total amount of Ni and Fe to a P content is 3 or more.

In the above embodiment, Ni, or Ni and Fe are contained more than P and thus easily form a compound with P just enough, and P is easily present in a precipitated state. This results in enhanced precipitation and thereby an appropriate strength enhancement effect. Furthermore, a solid solution of excessive P in the matrix phase and hence reduction in conductivity can be suppressed to effectively maintain high conductivity, as appropriate.

(4) An example of the presently disclosed covered electrical wire includes an embodiment in which the copper alloy includes one or more elements selected from C, Si, and Mn in an amount of 10 ppm by mass or more and 500 ppm by mass or less in total.

When C, Si, and Mn are included within a specific range, they function as a deoxidizer for Ni, Fe, P, Sn and the like, and suppress oxidation of these elements. Containing these elements allows high conductivity and high strength to be effectively obtained as appropriate. Furthermore, the above embodiment is also excellent in conductivity as it can suppress reduction in conductivity attributed to excessively containing C, Si, and Mn. Thus, the above embodiment is further excellent in conductivity and strength.

(5) An example of the presently disclosed covered electrical wire includes an embodiment in which the copper alloy wire provides a tensile strength of 385 MPa or more.

The above embodiment comprises a copper alloy wire having high tensile strength as a conductor and is thus excellent in strength.

(6) An example of the presently disclosed covered electrical wire includes an embodiment in which the copper alloy wire provides an elongation at fracture of 5% or more.

In the above embodiment, the covered electrical wire comprises as a conductor a copper alloy wire providing a large elongation at fracture, and is thus excellent in impact resistance. In addition, as the copper alloy wire provides a large elongation at fracture, the covered electrical wire is also resistant to fracture even when bent or twisted, and is thus also excellent in bendability and twistability.

(7) An example of the presently disclosed covered electrical wire includes an embodiment in which the copper alloy wire has a conductivity of 60% IACS or more.

In the above embodiment the covered electrical wire comprises a copper alloy wire having high conductivity as a conductor, and is thus excellent in conductivity.

(8) An example of the presently disclosed covered electrical wire includes an embodiment in which the copper alloy wire has a work-hardening exponent of 0.1 or more.

In the above embodiment, the copper alloy wire has as large a work-hardening exponent as 0.1 or more. Accordingly, in the embodiment, when the copper alloy is subjected to plastic-working, such as compression-working, accompanied by reduction in cross section, it is work-hardened to have a plastically worked portion enhanced in strength. Note that the presently disclosed covered electrical wire comprises a copper alloy wire per se having high strength, as described above, so that when it has a terminal such as a crimp terminal attached thereto, the former fixes the latter with large force (see item (9) described hereinafter). In addition, the high work-hardening exponent as described above allows work-hardening to enhance the conductor (or stranded wire) in strength at the terminal-connected portion. The covered electrical wire in the above embodiment thus allows the terminal to be further firmly fixed. Such a covered electrical wire is further excellent in fixing the terminal, and in addition, has the terminal-connected portion resistant to fracture against an impact and thus also has excellent impact resistance in the state with the terminal attached thereto.

(9) An example of the presently disclosed covered electrical wire includes an embodiment providing a terminal fixing force of 45 N or more.

How terminal fixing force, impact resistance energy in a state with a terminal attached, as will described hereinafter at items (10) and (15), and impact resistance energy, as will be described hereinafter at items (11) and (16), are measured will be described hereinafter.

In the above embodiment, when the covered electrical wire has a terminal such as a crimp terminal attached thereto, the covered electrical wire allows the terminal to be fixed firmly. The covered electrical wire in the embodiment is thus excellent in fixing the terminal. The covered electrical wire in the embodiment is thus excellent in conductivity and strength as well as in impact resistance, and also excellent in fixing a terminal. The covered electrical wire in the embodiment can be suitably used for the above-described terminal-equipped electrical wire and the like.

(10) An example of the presently disclosed covered electrical wire includes an embodiment in which an impact resistance energy in a state with a terminal attached is 3 J/m or more.

In the above embodiment, an impact resistance energy in a state with a terminal such as a crimp terminal attached is high. Accordingly, in the embodiment, when the covered electrical wire receives an impact in a state with a terminal attached thereto, the covered electrical wire has the terminal-connected portion resistant to fracture. The covered electrical wire in the embodiment is thus excellent in conductivity and strength as well as in impact resistance, and also excellent in impact resistance in a state with the terminal attached thereto. The covered electrical wire in the embodiment can be suitably used for the above-described terminal-equipped electrical wire and the like.

(11) An example of the presently disclosed covered electrical wire includes an embodiment in which the covered electrical wire provides an impact resistance energy of 6 J/m or more.

In the above embodiment, the covered electrical wire per se has high impact resistance energy. Accordingly, in the embodiment, even when the covered electrical wire receives an impact, it is resistant to fracture, and thus excellent in impact resistance.

(12) The presently disclosed terminal-equipped electrical wire comprises: the covered electrical wire according to any one of the above items (1) to (11); and a terminal attached to an end of the covered electrical wire.

The presently disclosed terminal-equipped electrical wire comprises the presently disclosed covered electrical wire. The presently disclosed covered electrical wire is thus excellent in conductivity and strength, as described above, and in addition, also excellent in impact resistance. Furthermore, since the presently disclosed terminal-equipped electrical wire comprises the presently disclosed covered electrical wire, it is also excellent in fatigue resistance, in fixing the covered electrical wire and a terminal such as a crimp terminal, and in impact resistance in a state with the terminal attached thereto, as has been described above.

(13) The presently disclosed copper alloy wire is composed of a copper alloy containing Ni, or Ni and Fe in an amount of 0.1% by mass or more and 1.6% by mass or less in total, and P in an amount of 0.05% by mass or more and 0.7% by mass or less, with a balance being Cu and impurities, in the copper alloy, a ratio of precipitation of P to solid solution of P being 1.1 or more, and has a wire diameter of 0.5 mm or less.

The presently disclosed copper alloy wire is a thin wire member composed of a copper-based material. Thus, when the presently disclosed copper alloy wire is used as a conductor for an electrical wire or the like in the form of a solid wire or a stranded wire, it is excellent in conductivity and strength, and in addition, contributes to weight reduction of the electrical wire. In particular, the presently disclosed copper alloy wire is composed of a copper alloy of a specific composition including Ni, or Ni and Fe, and P in a specific range. Thus, the presently disclosed copper alloy wire is excellent in conductivity and strength as described above, and in addition, also excellent in impact resistance. Therefore, by using the presently disclosed copper alloy wire as a conductor for an electrical wire, it is possible to construct an electrical wire excellent in conductivity and strength and in addition, also excellent in impact resistance, and furthermore, an electrical wire also excellent in fatigue resistance, in fixing a terminal such as a crimp terminal, and in impact resistance in a state with the terminal attached thereto.

Further, the presently disclosed copper alloy wire is composed of a copper alloy in which a ratio of precipitation of P to solid solution of P is 1.1 or more, and, as has been discussed above, a ratio of P present in the copper alloy in a precipitated state is high. The presently disclosed copper alloy wire can thus ensure high conductivity while increasing strength.

(14) The presently disclosed copper alloy stranded wire is formed of a plurality of copper alloy wires, each according to item (13), twisted together.

The presently disclosed copper alloy stranded wire substantially maintains the composition and characteristics of the copper alloy wire according to item (13) above. Thus, the presently disclosed copper alloy stranded wire is excellent in conductivity and strength, and in addition, also excellent in impact resistance. Therefore, by using the presently disclosed copper alloy stranded wire as a conductor for an electrical wire, it is possible to construct an electrical wire excellent in conductivity and strength and in addition, also excellent in impact resistance, and furthermore, an electrical wire also excellent in fatigue resistance, in fixing a terminal such as a crimp terminal, and in impact resistance in a state with the terminal attached thereto.

(15) An example of the presently disclosed copper alloy stranded wire includes an embodiment in which an impact resistance energy in a state with a terminal attached is 1.5 J/m or more.

In the above embodiment, an impact resistance energy in a state with a terminal attached is high. A covered electrical wire comprising a copper alloy stranded wire of the above embodiment as a conductor and an insulating covering layer can construct a covered electrical wire having a higher impact resistance energy in a state with a terminal attached thereto, typically the covered electrical wire according to item (10) above. Thus the above embodiment can be suitably used for a conductor of a covered electrical wire, a terminal-equipped electrical wire, and the like excellent in conductivity and strength as well as in impact resistance, and in addition, excellent in impact resistance in a state with a terminal attached thereto.

(16) An example of the presently disclosed copper alloy stranded wire includes an embodiment in which the copper alloy stranded wire has an impact resistance energy of 4 J/m or more.

In the above embodiment, the copper alloy stranded wire per se has high impact resistance energy. A covered electrical wire comprising the copper alloy stranded wire of the above embodiment as a conductor and an insulating covering layer can construct a covered electrical wire having higher impact resistance energy, typically the covered electrical wire according to item (11) above. Thus the above embodiment can be suitably applied to a conductor of a covered electrical wire, a terminal-equipped electrical wire, and the like which are excellent in conductivity and strength, and in addition, further excellent in impact resistance.

[Detailed Description of Embodiments of the Present Disclosure]

Hereinafter, embodiments of the present disclosure will be described in detail with reference to the drawings. In the figures, identical reference characters denote identically named components. A content of an element shall be a proportion by mass (% by mass or ppm by mass) unless otherwise specified. The present invention is defined by the terms of the claims, rather than these examples, and is intended to include any modifications within the meaning and scope equivalent to the terms of the claims.

[Copper Alloy Wire]

(Composition)

According to an embodiment, a copper alloy wire 1 is used for a conductor for an electrical wire such as a covered electrical wire 3 (see FIG. 1). Copper alloy wire 1 is composed of a copper alloy including a specific additive element in a specific range. The copper alloy is a Cu—Ni—(Fe)—P-based Cu (copper) alloy that contains Ni, or Ni and Fe at 0.1% or more and 1.6% or less in total, and P at 0.05% or more and 0.7% or less. Furthermore, the copper alloy may include Sn at 0.05% or more and 0.7% or less. The copper alloy is allowed to include impurities. "Impurities" mainly refer to inevitable matters. Each element will now be described in detail below.

Ni (Nickel) and Fe (Iron)

Ni and Fe are mainly combined with P and thereby precipitated and thus present in the matrix phase, or Cu, and thus contribute to enhancement in strength such as tensile strength.

When Ni, or Ni and Fe are contained in an amount of 0.1% or more in total, Ni and Fe can be combined with P to generate a precipitate satisfactorily, and by enhanced precipitation, copper alloy wire 1 can be excellent in strength. Further, the precipitation can suppress solid solution of P in the matrix phase to provide copper alloy wire 1 with high conductivity. Although depending on the amount of P and the manufacturing conditions, the strength of copper alloy wire 1 easily increase as the Ni and Fe contents increase. If high strength or the like is desired, the Ni content or the Ni and Fe total content (hereinafter collectively also referred to as a "total amount of Ni and Fe") can be 0.2% or more, even more than 0.35%, 0.4% or more, 0.45% or more.

Ni, or Ni and Fe contained in a range of 1.6% or less in total help to suppress coarsening of precipitates and the like. As a result of suppression of coarsening of precipitates, a copper alloy can be provided which can reduce fracture starting from coarse precipitates and thus be excellent in strength, and in addition, it is resistant to breakage in its production process when undergoing wire-drawing or the like, and is thus also excellent in manufacturability. Although depending on the amount of P and the manufacturing conditions, the smaller the Ni and Fe contents are, the easier it is to suppress coarsening of precipitates described above and the like. When it is desired to suppress coarsening of precipitates (and hence reduce fracture and breakage), and the like, the Ni content or the Ni and Fe total content can be 1.5% or less, even 1.2% or less, 1.0% or less, less than 0.9%.

The total amount of Ni and Fe falls within a range including 0.1% or more and 1.6% or less, even 0.2% or more and 1.5% or less, more than 0.35% and 1.2% or less, 0.4% or more and 1.0% or less, and 0.45% or more and less than 0.9% for example.

P (Phosphorus)

P is present such that it mainly precipitates together with Ni and Fe, and contributes to improvement in strength such as tensile strength, that is, mainly functions as a precipitation enhancing element.

When P is contained in an amount of 0.05% or more, it can combine with Ni and Fe to produce precipitates satisfactorily, and by enhanced precipitation, copper alloy wire 1 can be excellent in strength. Although depending on the amount of Fe and the manufacturing conditions, the strength of copper alloy wire 1 tends to increase as the P content increases. If high strength or the like is desired, the P content can be more than 0.1%, even 0.11% or more, 0.12% or more. It is to be noted that it is permitted that a portion of the P contained functions as a deoxidizing agent and is present as an oxide in the matrix phase.

P contained in a range of 0.7% or less helps to suppress coarsening of precipitates and the like and can reduce fracture, breakage, and the like. Although depending on the amount of Fe and the manufacturing conditions, the smaller the P content is, the easier it is to suppress the coarsening of the precipitates. When it is desired to suppress coarsening of precipitates (and hence reduce fracture and breakage), and the like, the P content can be 0.6% or less, even 0.5 or less, 0.35% or less, even 0.3% or less, 0.25% or less.

The P content falls within a range including 0.05% or more and 0.7% or less, even more than 0.1% and 0.6% or less, 0.11% or more and 0.5% or less, 0.11% or more and 0.3% or less, and 0.12% or more and 0.25% or less.

(Ni+Fe)/P

In addition to containing Ni, Fe and P in the above specific ranges, it is preferable to appropriately include Ni, or Ni and Fe relative to P. When Ni, or Ni and Fe are contained more than P, Ni, or Ni and Fe easily form a compound with P just enough. This results in enhanced precipitation and thereby an appropriate strength enhancement effect. Furthermore, a solid solution of excessive P in the matrix phase and hence reduction in conductivity can be suppressed to effectively maintain high conductivity, as appropriate. Copper alloy wire 1 can thus be excellent in conductivity and in addition, high in strength.

Specifically, a ratio in mass of a total amount of Ni and Fe to a P content ((Ni+Fe)/P) is 3 or more is included. ((Ni+Fe)/P) of 3 or more allows enhanced precipitation and hence a strength enhancement effect, as described above, to be obtained satisfactorily and thus provides more excellent strength, and also tends to provide excellent conductivity. Larger (Ni+Fe)/P) tends to provide more excellent conductivity, and (Ni+Fe)/P) can be greater than 3, 3.1 or more, even 4.0 or more. (Ni+Fe)/P) can for example be selected in a range of 30 or less. (Ni+Fe)/P) of 20 or less, even 10 or less helps to suppress coarsening of precipitates caused by excessive Ni and Fe.

(Ni+Fe)/P) is for example 3 or more and 30 or less, even more than 3 and 20 or less, 3.1 or more and 20 or less, 4.0 or more and 10 or less.

Sn (Tin)

A copper alloy constituting copper alloy wire 1 of an embodiment can include Sn in an amount of 0.05% or more and 0.7% or less.

Sn is present mainly as a solid solution in the matrix phase, or Cu, and contributes to improvement in strength such as tensile strength, that is, mainly functions as a solid solution enhancing element.

When Sn is contained in an amount of 0.05% or more, enhanced solid solution of Sn and hence a strength enhancement effect can be obtained, and copper alloy wire 1 can be further excellent in strength. The larger the Sn content is, the easier it is to have higher strength. When high strength is desired, the Sn content can be set to 0.08% or more, even 0.1% or more, 0.12% or more.

When Sn is contained in a range of 0.7% or less, reduction in conductivity attributed to excessive solid solution of Sn in the matrix phase can be suppressed and copper alloy wire 1 can have high conductivity. In addition, reduction in workability caused by excessive solid solution of Sn can be suppressed. Accordingly, wire-drawing or similar plastic working can be easily done and excellent manufacturability can also be obtained. When high conductivity and satisfactory workability are desired, the Sn content can be 0.6% or less, even 0.55% or less, 0.5% or less.

The Sn content falls within a range including 0.05% or more and 0.7% or less, even 0.08% or more and 0.6% or less, 0.1% or more and 0.55% or less, 0.12% or more and 0.5% or less for example.

Copper alloy wire 1 of an embodiment has high strength by enhanced precipitation and enhanced solid solution, as described above. Therefore, even when artificial aging and softening are performed in the manufacturing process, significantly strong and tough copper alloy wire 1 can be obtained having high strength while also having large elongation or the like.

C (Carbon), Si (Silicon), and Mn (Manganese)

A copper alloy constituting copper alloy wire 1 of an embodiment can include a deoxidizing element that functions as a deoxidizer for Ni, Fe, P, Sn and the like. Specifically, the deoxidizing element includes C, Si and Mn. The copper alloy includes one or more elements selected from C, Si, and Mn in an amount of 10 ppm or more and 500 ppm or less in total.

If the manufacturing process (e.g., a casting process) is done in an oxygen-containing atmosphere such as the air, elements such as Ni, Fe, P, Sn and the like may be oxidized. If these elements become oxides, the above-described precipitates and the like cannot be appropriately formed and/or solid solution cannot be formed in the matrix phase. As a result, high conductivity and high strength by containing Ni, Fe and P, and enhanced solid solution by containing Sn may not be effectively obtained as appropriate. These oxides serve as points allowing fracture to start in wire-drawing or the like, and may invite reduction in productivity. Including at least one element, preferably two elements, of the deoxidizing elements (in the latter case, C and Mn or C and Si are preferable), more preferably, all of the three elements in a specific range is recommendable. This more reliably contemplates precipitation of Ni, Fe and P to ensure enhanced precipitation and high conductivity, and enhanced solid solution of Sn, to allow copper alloy wire 1 to be excellent in conductivity and high in strength.

When the deoxidizing elements' total content is 10 ppm or more, the deoxidizing elements can suppress oxidation of elements such as Ni, Fe, Sn and the like described above. The larger the total content is, the easier it is to obtain a deoxidation effect, and the total content can be 20 ppm or more, even 30 ppm or more.

If the total content is 500 ppm or less, it is difficult to invite reduction in conductivity attributed to otherwise excessively containing these deoxidizing elements, and excellent conductivity can be provided. The smaller the total content is, the easier it is to suppress reduction in conductivity, and the total content can be 300 ppm or less, even 200 ppm or less, 150 ppm or less.

The deoxidizing elements' total content falls within a range for example including 10 ppm or more and 500 ppm or less, even 20 ppm or more and 300 ppm or less, and 30 ppm or more and 200 ppm or less.

The content of C alone is preferably 10 ppm or more and 300 ppm or less, more preferably 10 ppm or more and 200 ppm or less, particularly preferably 30 ppm or more and 150 ppm or less.

The content of Mn alone or the content of Si alone is preferably 5 ppm or more and 100 ppm or less, more preferably more than 5 ppm and 50 ppm or less. The total content of Mn and Si is preferably 10 ppm or more and 200 ppm or less, more preferably more than 10 ppm and 100 ppm or less.

When C, Mn and Si are contained in the above described ranges, respectively, it is easy to satisfactorily obtain a deoxidation effect. For example, the copper alloy can have an oxygen content of 20 ppm or less, 15 ppm or less, even 10 ppm or less.

(Structure)

A copper alloy constituting copper alloy wire 1 of an embodiment includes having a structure in which precipitates and/or crystallites of Ni, Fe and P are dispersed. When the copper alloy has a structure in which precipitates or the like are dispersed, preferably a structure in which fine precipitates or the like are uniformly dispersed, it can be expected to ensure high strength by enhanced precipitation, and high conductivity by reduction of solid solution of P or the like in the matrix phase.

(Ratio of Precipitation of P to Solid Solution of P in Copper Alloy)

A ratio of precipitation of P to solid solution of P in the copper alloy is 1.1 or more. A ratio of precipitation of P to solid solution of P means a ratio of a proportion of precipitation of P to a proportion of solid solution of P, and the higher the ratio is, the higher a ratio of P present in the copper alloy in a precipitated state is. How P is present can be examined through x-ray absorption spectroscopy (XAS) measurement. The ratio of precipitation of P to solid solution of P can be estimated through XAS.

Figure 4:
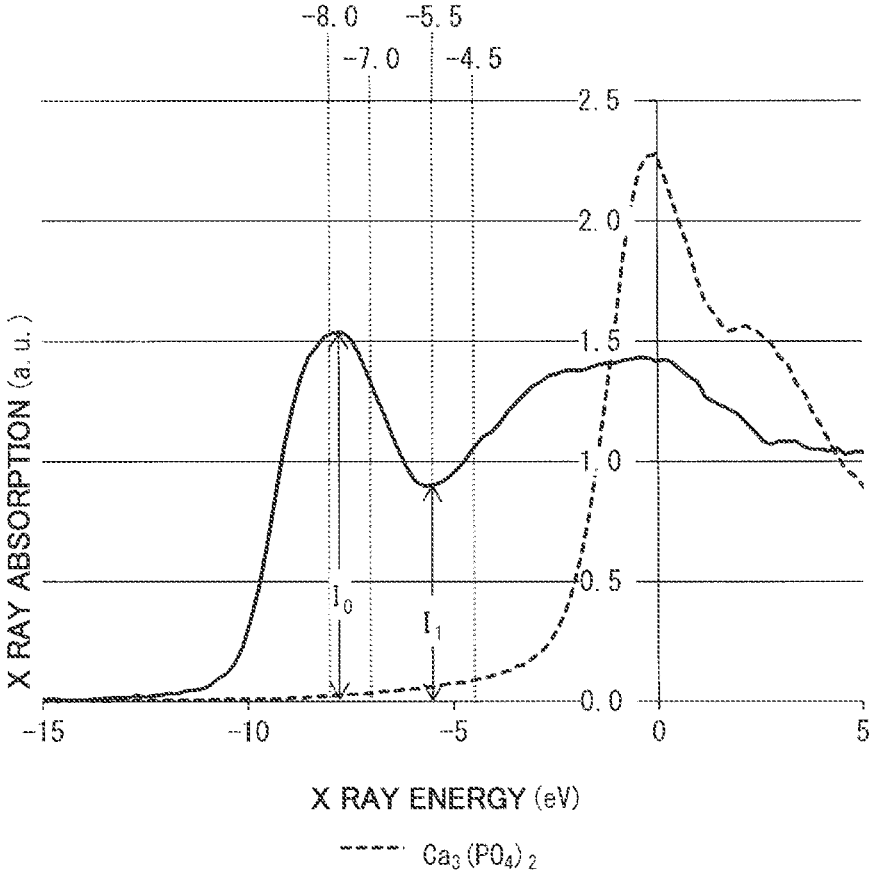
FIG. 4 is a diagram for illustrating a method for measuring a ratio of precipitation of P to solid solution of P in a copper alloy in an embodiment, showing an example of a K-edge XANES spectrum of P of a copper alloy wire.

A method for measuring a ratio of precipitation of P to solid solution of P will be described. Using copper alloy wire 1 as a sample, a XAS spectrum in a vicinity of the K-edge (hereinafter also referred to as a XANES spectrum) of P of copper alloy wire 1 is measured. An example of P K-edge XANES spectrum is shown in FIG. 4. The XANES spectrum shown in FIG. 4 is a normalized spectrum, and the horizontal axis represents x-ray energy (eV) and the vertical axis represents x-ray absorption (in an arbitrary unit (a.u.)). Herein, the horizontal axis represents relative x-ray energy when a peak top of a maximum peak observed from tricalcium phosphate ($Ca_3(PO_4)_2$) measured as a standard sample is set to zero eV. As the standard sample, calcium hydrogen phosphate ($CaHPO_4$) may be used instead of tricalcium phosphate. For normalization of X-ray absorption along the vertical axis, a XANES spectrum of a copper alloy wire as a sample to be measured is analyzed using analysis software. For example, the copper alloy wire is exposed to x ray to obtain fluorescent x-ray intensity, which is in turn plotted for each x-ray energy, and an arbitrary range from a lowest −32.1 eV to a highest −13.5 eV is subtracted as a background region and an arbitrary range from a lowest +13.4 eV to a highest +57.4 eV is set as a normalized region. It should be noted, however, that it is assumed that there is at least 10 eV or more between the two points that define the background region, and there is at least 20 eV or more between the two points that define the normalized region. The software used for the analysis can for example be commercially available software such as REX2000 available from Rigaku Corporation or free software such as Athena specialized for analysis of XANES spectrum. Such analysis software is used through the above-described analysis procedure to obtain a P K-edge XANES spectrum of the copper alloy wire, as shown in FIG. 4. In FIG. 4, a normalized XANES spectrum of the copper alloy wire is indicated by a solid line, and a XANES spectrum of tricalcium phosphate is additionally indicated by a dotted line. In the obtained XANES spectrum, a maximum value of x-ray absorption within a range along the horizontal axis from −8.0 eV to −7.0 eV is defined as a degree of precipitation $I_0$ and a minimum value of x-ray absorption within a range along the horizontal axis from −5.5 eV to −4.5 eV is defined as a degree of solid solution $I_1$, and a ratio of degree of precipitation $I_0$ to degree of solid solution $I_0$, i.e., $I_0/I_1$, is defined as a ratio of precipitation of P to solid solution of P. Software similar to REX2000 or Athena that is capable of analyzing a XANES spectrum can also be used to determine a ratio of precipitation of P to solid solution of P through the above analysis procedure.

The ratio of precipitation of P to solid solution of P is variable by a manufacturing condition, for example, a condition of a heat treatment performed after wire drawing. Specifically, performing the heat treatment at an increased temperature, holding the heat treatment for a longer period of time, or the like provides an increased proportion of precipitation of P and tends to provide a higher ratio of precipitation of P to solid solution of P. The ratio of precipitation of P to solid solution of P can be 1.2 or more, 1.3 or more, 1.4 or more, even 1.5 or more. The ratio of precipitation of P to solid solution of P has an upper limit set for example to 2.5 or less, even 2.0 or less.

Further, the copper alloy may have a fine crystal structure. This helps the above-described precipitates or the like to be present such that they are uniformly dispersed, and further higher strength can be expected. In addition, there are few coarse crystal grains that can serve as fracture starting points, which provides resistance to fracture. This helps to increase toughness such as elongation and further excellent impact resistance is thus expected. Further, in that case, when copper alloy wire 1 of the embodiment is used as a conductor for an electrical wire such as covered electrical wire 3 and a terminal such as a crimp terminal is attached to the conductor, the terminal can be firmly fixed and a force to fix the terminal can thus be easily increased.

Specifically, when copper alloy wire 1 has an average crystal grain size of 10 μm or less, it helps to obtain the effect described above, and it can be 7 μm or less, even 5 μm or less. The crystal grain size can be adjusted to have a predetermined size for example by adjusting manufacturing conditions (such as a degree of working and a heat treatment temperature, etc., which are also applied hereinafter) depending on the composition (Ni, Fe, P, Sn contents, the value of (Ni+Fe)/P) etc., which are also applied hereinafter).

The copper alloy wire's average crystal grain size is measured as follows: A transverse cross section of the copper alloy wire orthogonal to its longitudinal direction is polished with a cross section polisher (CP) and observed with a scanning electron microscope (SEM). From the observed image, an observation range of a predetermined area is taken and any crystal grain present in the observation range is measured in area. A diameter of a circle having an area equivalent to that of each crystal grain is calculated as a crystal grain size, and an average value of such crystal grain sizes is defined as an average crystal grain size. The crystal grain size can be calculated using a commercially available image processing device. The observation range can be a range including 50 or more crystal grains, or the entirety of the transverse cross section. By making the observation range sufficiently large as described above, an error caused by a matter other than crystal (such as precipitates) can be sufficiently reduced.

(Wire Diameter)

When copper alloy wire 1 of an embodiment is manufactured through a process, it can undergo wire-drawing with an adjusted degree of working (or an adjusted cross section reduction ratio) or the like to have a wire diameter of a predetermined size. In particular, when copper alloy wire 1 is a thin wire having a wire diameter of 0.5 mm or less, it can be suitably used for a conductor for an electrical wire for which reduction in weight is desired, e.g., a conductor for an electrical wire to be routed in an automobile. The wire diameter can be 0.35 mm or less, even 0.25 mm or less.

(Cross Sectional Shape)

Copper alloy wire 1 of an embodiment can have a transverse cross sectional shape selected as appropriate. A representative example of copper alloy wire 1 is a round wire having a round shape in a transverse cross section. The transverse cross sectional shape varies depending on the shape of the die used for wire-drawing, and the shape of a mold when copper alloy wire 1 is a compressed stranded wire, etc. Copper alloy wire 1 can be, for example, a quadrangular wire having a rectangular or similar transverse cross-sectional shape, a shaped wire having a hexagonal or other polygonal shape, an elliptical shape or the like. Copper alloy wire 1 constituting the compressed stranded wire is typically a shaped wire having an indefinite transverse cross sectional shape.

(Characteristics)

Tensile Strength, Elongation at Fracture, and Conductivity

According to an embodiment, copper alloy wire 1 is composed of a copper alloy having the above described specific composition, and is thus excellent in conductivity and in addition, high in strength. Furthermore, copper alloy wire 1 of the embodiment is manufactured through an appropriate heat treatment, and thus has high strength, high toughness and high conductivity in a good balance. Copper alloy wire 1 of such an embodiment can be suitably used as a conductor for covered electrical wire 3 or the like. Copper alloy wire 1 includes satisfying at least one, preferably two, more preferably all of: a tensile strength of 385 MPa or more; an elongation at fracture of 5% or more; and a conductivity of 60% IACS or more. An example of copper alloy wire 1 has a conductivity of 60% IACS or more and a tensile strength of 385 MPa or more. Alternatively, an example of copper alloy wire 1 has an elongation at fracture of 5% or more. When copper alloy wire 1 has tensile strength of 390 MPa or more, even 395 MPa or more, 400 MPa or more, in particular, it provides higher strength.

When higher strength is desired, the tensile strength can be 405 MPa or more, 410 MPa or more, even 415 MPa or more.

When higher toughness is desired, the elongation at fracture can be 6% or more, 7% or more, 8% or more, 9.5% or more, even 10% or more.

When higher conductivity is desired, the conductivity can be 62% IACS or more, 63% IACS or more, even 65% IACS or more.

Work Hardening Exponent

An example of copper alloy wire 1 of an embodiment has a work hardening exponent of 0.1 or more.

A work hardening exponent is defined as an exponent n of a true strain ε in an equation of $\sigma=C\times\varepsilon^n$ where σ and ε represent true stress and true strain, respectively, in a plastic strain region in a tensile test when a test force is applied in a uniaxial direction. In the above equation, C represents a strength constant.

The above exponent n can be determined by conducting a tensile test using a commercially available tensile tester, and preparing an S-S curve (see also JIS G 2253 (2011)).

Larger work hardening exponents facilitate work hardening, and a thus worked portion can be effectively increased in strength through work hardening. For example, when copper alloy wire 1 is used as a conductor for an electrical wire such as covered electrical wire 3, and a terminal such as a crimp terminal is attached to the conductor, the conductor has a terminal attachment portion, which is a worked portion having undergone plastic working such as compression-working. Although this worked portion has undergone plastic working, such as compression-working, accompanied by a reduction in cross section, it is harder than before plastic working and thus enhanced in strength. Thus, the worked portion, that is, the terminal attachment portion of the conductor and a vicinity thereof can be a less weak point in strength. A work hardening exponent of 0.11 or more, even 0.12 or more, 0.13 or more, helps work hardening to effectively enhance strength. Depending on the composition, the manufacturing conditions and the like, it can be expected that the conductor has a terminal attachment portion which maintains a level of strength equivalent to that of the main wire portion of the conductor. The work hardening exponent varies depending on the composition, the manufacturing conditions and the like, and accordingly, no upper limit is specifically set therefore.

The copper alloy wire can have tensile strength, elongation at fracture, conductivity, and a work hardening exponent as prescribed in magnitude by adjusting the composition, the manufacturing conditions and the like. For example, larger Ni, Fe and P, and Sn, where appropriate, contents and higher degrees of wire-drawing (or smaller wire diameters) tend to increase tensile strength. For example, when wire-drawing is followed by a heat treatment performed at high temperature, elongation at fracture and conductivity tend to be high and tensile strength tends to be low.

Weldability

Copper alloy wire 1 of an embodiment also has excellent weldability as an effect. For example, when copper alloy wire 1 or a copper alloy stranded wire 10 described hereinafter is used as a conductor for an electrical wire and another conductor wire or the like is welded thereto at a portion for branching from the conductor, the welded portion is resistant to fracture and thus strongly welded.

[Copper Alloy Stranded Wire]

Copper alloy stranded wire 10 of an embodiment uses copper alloy wire 1 of an embodiment as an elemental wire, and is thus formed of a plurality of copper alloy wires 1 twisted together. Copper alloy stranded wire 10 substantially maintains the composition, structure and characteristics of copper alloy wire 1 serving as an elemental wire. Copper alloy stranded wire 10 easily has a larger cross sectional area than a single elemental wire, and accordingly, can have increased force to endure an impact and is thus further excellent in impact resistance. In addition, when copper alloy stranded wire 10 is compared with a solid wire having the same cross-sectional area, the former is more easily bent and twisted and thus also excellent in bendability and twistability. As such, when copper alloy stranded wire 10 is used as a conductor for an electrical wire, it is resistant to breakage when routed, repeatedly bent, or the like. Furthermore, copper alloy stranded wire 10 has a plurality of copper alloy wires 1 that are easily work-hardened, as described above, twisted together. As such, when copper alloy stranded wire 10 is used as a conductor for an electrical wire such as covered electrical wire 3 and a terminal such as a crimp terminal is attached thereto, the terminal can be further firmly fixed thereto. While FIG. 1 shows copper alloy stranded wire 10 composed of seven wires concentrically twisted together as an example, how many copper alloy wires 1 are twisted together and how they are twisted together can be changed as appropriate.

After being twisted together, copper alloy stranded wire 10 can be compression-molded to be a compressed stranded wire (not shown). A compressed stranded wire is excellent in stability in a stranded state, and when the compressed stranded wire is used as a conductor for an electrical wire such as covered electrical wire 3, insulating covering layer 2 or the like is easily formed on the circumference of the conductor. In addition, when the compressed stranded wire is compared with a simply stranded wire, the former tends to have better mechanical properties and in addition, can be smaller in diameter than the latter.

Copper alloy stranded wire 10 can have a wire diameter, a cross-sectional area, a stranding pitch, and the like appropriately selected depending on the wire diameter of copper alloy wire 1, the cross-sectional area of copper alloy wire 1, the number of copper alloy wires 1 twisted together, and the like.

When copper alloy stranded wire 10 has a cross-sectional area for example of 0.03 $mm^2$ or more, the conductor will have a large cross-sectional area, and hence be small in electric resistance and excellent in conductivity. Further, when copper alloy stranded wire 10 is used as a conductor for an electrical wire such as covered electrical wire 3 and a terminal such as a crimp terminal is attached to the conductor, the conductor having a somewhat large cross sectional area facilitates attaching the terminal thereto. Furthermore, as has been described above, the terminal can be firmly fixed to copper alloy stranded wire 10, and in addition, excellent impact resistance in a state with the terminal attached is also provided. The cross-sectional area can be 0.1 $mm^2$ or more. When the cross-sectional area is for example 0.5 $mm^2$ or less, copper alloy stranded wire 10 can be lightweight.

When copper alloy stranded wire 10 has a stranding pitch for example of 10 mm or more, even elemental wires (or copper alloy wires 1) which are thin wires having a wire diameter of 0.5 mm or less can be easily twisted together, and copper alloy stranded wire 10 is thus excellent in manufacturability. A stranding pitch for example of 20 mm or less prevents the stranded wire from being loosened when bent, and excellent bendability is thus provided.

Impact Resistance Energy in State with Terminal Attached

Copper alloy stranded wire 10 of an embodiment is composed of elemental wire that is copper alloy wire 1 composed of a specific copper alloy as described above. Accordingly, when copper alloy stranded wire 10 is used for a conductor for a covered electrical wire or the like and a terminal such as crimp terminal is attached to an end of the conductor, and in that condition copper alloy stranded wire 10 receives an impact, copper alloy stranded wire 10 has the terminal attachment portion and a vicinity thereof resistant to fracture. Quantitatively, copper alloy stranded wire 10 with the terminal attached thereto as described above has impact resistance energy of 1.5 J/m or more as an example. The greater the impact resistance energy in the state with the terminal attached is, the more resistant to fracture the terminal attachment portion and a vicinity thereof are against an impact. When such a copper alloy stranded wire 10 is used as a conductor, a covered electrical wire or the like which is excellent in impact resistance in a state with a terminal attached thereto can be constructed. Copper alloy stranded wire 10 in the state with the terminal attached thereto preferably has an impact resistance energy of 1.6 J/m or more, more preferably 1.7 J/m or more, and no upper limit is specifically set therefore.

Impact Resistance Energy

Copper alloy stranded wire 10 of an embodiment is composed of elemental wire that is copper alloy wire 1 composed of a specific copper alloy as described above, and it is thus resistant to fracture against an impact or the like. Quantitatively, copper alloy stranded wire 10 has an impact resistance energy of 4 J/m or more for example. The larger the impact resistance energy is, the more resistant to fracture copper alloy stranded wire 10 per se is when it receives an impact. When such a copper alloy stranded wire 10 is used as a conductor, a covered electrical wire or the like excellent in impact resistance can be constructed. Copper alloy stranded wire 10 preferably has an impact resistance energy of 4.2 J/m or more, more preferably 4.5 J/m or more, and no upper limit is specifically set therefore.

Note that it is preferable that copper alloy wire 1 in the form of a solid wire in a state with a terminal attached thereto and that in the form of a solid wire in a lone state also have an impact resistance energy satisfying the above range. When copper alloy stranded wire 10 of the embodiment is compared with copper alloy wire 1 in the form of a solid wire, the former tends to have higher impact resistance energy in the state with the terminal attached and in the lone state.

[Covered Electrical Wire]

While copper alloy wire 1 and copper alloy stranded wire 10 of an embodiment can be used as a conductor as they are, copper alloy wire 1 and copper alloy stranded wire 10 surrounded by an insulating covering layer are excellently insulative. Covered electrical wire 3 of an embodiment includes a conductor and insulating covering layer 2 surrounding the conductor, and the conductor is copper alloy stranded wire 10 of an embodiment. Another embodiment of the covered electrical wire is a covered electrical wire including a conductor implemented by copper alloy wire 1 (in the form of a solid wire). FIG. 1 shows an example with a conductor including copper alloy stranded wire 10.

Insulating covering layer 2 is composed of an insulating material for example including polyvinyl chloride (PVC), a non-halogen resin (for example, polypropylene (PP)), an excellently flame retardant material, and the like. Known insulating materials can be used.

Insulating covering layer 2 can be selected in thickness as appropriate depending on insulating strength as prescribed, and is thus not particularly limited in thickness.

Terminal Fixing Force

As has been described above, covered electrical wire 3 of an embodiment comprises, as a conductor, copper alloy stranded wire 10 composed of an elemental wire that is copper alloy wire 1 composed of a specific copper alloy. Accordingly, in a state with a terminal such as a crimp terminal attached thereto, covered electrical wire 3 allows the terminal to be firmly fixed thereto. Quantitatively, covered electrical wire 3 has a terminal fixing force of 45 N or more for example. Larger terminal fixing force is preferable as it can firmly fix the terminal and easily maintains covered electrical wire 3 (or the conductor) and the terminal in a connected state. The terminal fixing force is preferably 50 N or more, more than 55 N, further preferably 58 N or more, and no upper limit is specifically set therefore.

Impact Resistance Energy in State with Terminal Attached

When covered electrical wire 3 of an embodiment in a state with a terminal attached thereto and that in a lone state are compared with a bare conductor without insulating covering layer 2, that is, copper alloy stranded wire 10 of an embodiment, the former tends to have higher impact resistance energy than the latter. Depending on insulating covering layer 2's constituent materials, thickness or the like, covered electrical wire 3 in the state with the terminal attached thereto and that in the lone state may have impact resistance energy further increased as compared with the bare conductor. Quantitatively, covered electrical wire 3 in the state with the terminal attached thereto has an impact resistance energy of 3 J/m or more for example. When covered electrical wire 3 in the state with the terminal attached thereto has larger impact resistance energy, the terminal attachment portion is more resistant to fracture when it receives an impact, and the impact resistance energy is preferably 3.2 J/m or more, more preferably 3.5 J/m or more, and no upper limit is specifically set therefore.

Impact Resistance Energy

Furthermore, quantitatively, covered electrical wire 3 has an impact resistance energy (hereinafter also referred to as the main wire's impact resistance energy) of 6 J/m or more for example. The larger the main wire's impact resistance energy is, the more resistant to fracture the wire is when it receives an impact, and it is preferably 6.5 J/m or more, even 7 J/m or more, 8 J/m or more, and no upper limit is specifically set therefore.

When covered electrical wire 3 has insulating covering layer 2 removed therefrom to be a conductor alone, that is, copper alloy stranded wire 10 alone, and the conductor's impact resistance energy is measured in a state in which the conductor has a terminal attached thereto and in a state in which the conductor is alone, the conductor assumes substantially the same value as copper alloy stranded wire 10 described above. Specifically, the conductor comprised by covered electrical wire 3 in the state with the terminal attached to the conductor has an impact resistance energy of 1.5 J/m or more, and the conductor comprised by covered electrical wire 3 has an impact resistance energy of 4 J/m or more for example.

Note that it is preferable that a covered electrical wire comprising copper alloy wire 1 in the form of a solid wire as a conductor also have at least one of the terminal fixing force, the impact resistance energy in the state with the terminal attached, and the main wire's impact resistance energy satisfying the above-described range. When covered electrical wire 3 of an embodiment comprising a conductor that is copper alloy stranded wire 10 is compared with a covered electrical wire using copper alloy wire 1 in the form of a solid wire as a conductor, the former tends to have a larger terminal fixing force, a larger impact resistance energy in the state with the terminal attached, and a larger impact resistance energy of the main wire than the latter.

Covered electrical wire 3 or the like of an embodiment can have the terminal fixing force, the impact resistance energy in the state with the terminal attached, and the main wire's impact resistance energy to be of a magnitude as prescribed by adjusting the composition, manufacturing conditions and the like of copper alloy wire 1, the constituent materials, thickness and the like of insulating covering layer 2, and the like. For example, copper alloy wire 1 has its composition, manufacturing conditions and the like adjusted so that characteristics such as the aforementioned tensile strength, elongation at fracture, conductivity, work hardening exponent and the like satisfy the above specified ranges.

[Terminal-Equipped Electrical Wire]

Figure 2:
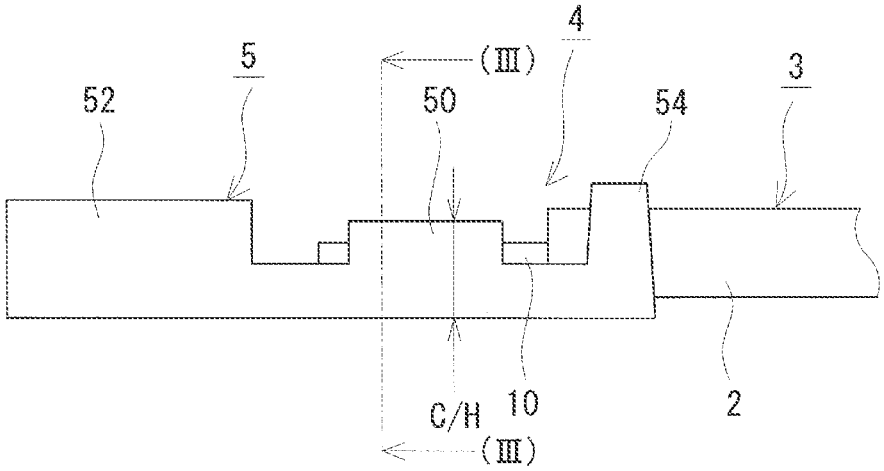
FIG. 2 is a schematic side view showing a vicinity of a terminal of a terminal-equipped electrical wire according to an embodiment.

As shown in FIG. 2, a terminal-equipped electrical wire 4 of an embodiment includes covered electrical wire 3 of an embodiment and a terminal 5 attached to an end of covered electrical wire 3. Herein, terminal 5 is a crimp terminal including a female or male fitting portion 52 at one end and an insulation barrel portion 54 at the other end for gripping insulating covering layer 2, and a wire barrel portion 50 at an intermediate portion for gripping the conductor (in FIG. 2, copper alloy stranded wire 10) by way of example. The crimp terminal is crimped to an end of the conductor that is exposed by removing insulating covering layer 2 at an end of covered electrical wire 3, and the crimp terminal is electrically and mechanically connected to the conductor. Other than a crimping type such as a crimp terminal, terminal 5 is of a weld type to which a molten conductor is connected as one example. A terminal-equipped electrical wire according to another embodiment comprises a covered electrical wire using copper alloy wire 1 (a solid wire) as a conductor.

Terminal-equipped electrical wire 4 may include an embodiment in which one terminal 5 is attached to each covered electrical wire 3 (see in FIG. 2), and an embodiment in which one terminal 5 is provided for a plurality of covered electrical wires 3. That is, terminal-equipped electrical wire 4 includes an embodiment including one covered electrical wire 3 and one terminal 5, an embodiment including a plurality of covered electrical wires 3 and one terminal 5, and an embodiment including a plurality of covered electrical wires 3 and a plurality of terminals 5. When a plurality of electrical wires are provided, using a binder or the like to bind the plurality of electrical wires together helps to easily handle terminal-equipped electrical wire 4.

[Characteristics of Copper Alloy Wire, Copper Alloy Stranded Wire, Covered Electrical Wire, and Terminal-Equipped Electrical Wire]

According to an embodiment, each elemental wire of copper alloy stranded wire 10, each elemental wire constituting the conductor of covered electrical wire 3, and each elemental wire constituting the conductor of terminal-equipped electrical wire 4 all maintain copper alloy wire 1's composition, structure and characteristics or have characteristics equivalent thereto. Accordingly, an example of each elemental wire above satisfies at least one of a tensile strength of 385 MPa or more, an elongation at fracture of 5% or more, and a conductivity of 60% IACS or more.

Terminal 5 such as a crimp terminal which terminal-equipped electrical wire 4 is per se equipped with can be used as a terminal used for measuring terminal-equipped electrical wire 4's terminal fixing force and impact resistance energy in the state with the terminal attached.

[Application of Copper Alloy Wire, Copper Alloy Stranded Wire, Covered Electrical Wire, and Terminal-Equipped Electrical Wire]

Covered electrical wire 3 of an embodiment can be used for wiring portions of various electric devices and the like. In particular, covered electrical wire 3 according to an embodiment is suitably used in applications with terminal 5 attached to an end of covered electrical wire 3, e.g., transporting vehicles such as automobiles and airplanes, controllers for industrial robots, and the like. Terminal-equipped electrical wire 4 of an embodiment can be used for wiring of various electric devices such as the above-described transporting vehicles and controllers. Covered electrical wire 3 and terminal-equipped electrical wire 4 of such an embodiment can be suitably used as constituent elements of various wire harnesses such as automobile wire harnesses. The wire harness including covered electrical wire 3 and terminal-equipped electrical wire 4 according to an embodiment easily maintains connection with terminal 5 and can thus enhance reliability. Copper alloy wire 1 of an embodiment and copper alloy stranded wire 10 of an embodiment can be used as a conductor for an electrical wire such as covered electrical wire 3 and terminal-equipped electrical wire 4.

[Effect]

According to an embodiment, copper alloy wire 1 is composed of a copper alloy of a specific composition including Ni, or Ni and Fe, and P in a specific range. Thus, copper alloy wire 1 is excellent in conductivity and strength, and in addition, also excellent in impact resistance. Furthermore, as a ratio of precipitation of P to solid solution of P in the copper alloy is 1.1 or more, a ratio of P present in the copper alloy in a precipitated state is high, and high conductivity is ensured while strength is increased. Copper alloy stranded wire 10 of an embodiment having copper alloy wire 1 as an elemental wire is also excellent in conductivity and strength, and in addition, also excellent in impact resistance.

Covered electrical wire 3 of an embodiment comprises, as a conductor, copper alloy stranded wire 10 of an embodiment composed of an elemental wire that is copper alloy wire 1 of an embodiment. Covered electrical wire 3 is thus excellent in conductivity and strength, and in addition, also excellent in impact resistance. Furthermore, when covered electrical wire 3 has terminal 5 such as a crimp terminal attached thereto, covered electrical wire 3 can firmly fix terminal 5, and in addition, it is also excellent in impact resistance in a state with terminal 5 attached.

Terminal-equipped electrical wire 4 of an embodiment comprises covered electrical wire 3 of an embodiment. Terminal-equipped electrical wire 4 is thus excellent in conductivity and strength, and in addition, also excellent in impact resistance. Furthermore, terminal-equipped electrical wire 4 can firmly fix terminal 5, and in addition, it is also excellent in impact resistance in a state with terminal 5 attached.

[Manufacturing Method]

Copper alloy wire 1, copper alloy stranded wire 10, covered electrical wire 3, and terminal-equipped electrical wire 4 according to an embodiment can be manufactured in a manufacturing method including, for example, the following steps. Hereinafter, each step will be outlined.

(Copper Alloy Wire)

<Casting Step> A copper alloy having the above specific composition is molten and continuously cast to produce a cast material.

<Wire-Drawing Step> The cast material is subjected to wire-drawing to produce a wire-drawn member.

<Heat Treatment Step> The wire-drawn member is subjected to a heat treatment.

This heat treatment is assumed to representatively include artificial aging to precipitate P together with Ni and Fe from a copper alloy in which Ni, Fe and P are present in the form of a solid solution, and softening to improve elongation of a wire-drawn member work-hardened by wire-drawing done to attain a final wire diameter. Hereinafter, this heat treatment will be referred to as an aging and softening treatment.

A heat treatment other than the aging and softening treatment can include at least one of a solution treatment and an intermediate heat treatment as below.

The solution treatment is a heat treatment one purpose of which is to provide a supersaturated solid solution, and the treatment can be applied at any time after the casting step before the aging and softening treatment.

The intermediate heat treatment is a heat treatment performed as follows: after the casting step when plastic working (including rolling, extrusion and the like other than wire drawing) is performed, strain accompanying the working is removed to improve workability as one purpose of the heat treatment, and, depending on the condition(s), it can also be expected that the intermediate heat treatment provides some degree of aging and softening. The intermediate heat treatment can be applied to: a cast material having been worked before wire-drawing; an intermediate wire-drawn material in the course of wire-drawing; and the like.

(Copper Alloy Stranded Wire)

Manufacturing copper alloy stranded wire 10 comprises the above-described <casting step>, <wire drawing step> and <heat treatment step>, and in addition thereto, the following wire stranding step. When forming a compressed stranded wire, the following compression step is further comprised.

<Wire stranding step> A plurality of wire-drawn members each as described above are twisted together to produce a stranded wire. Alternatively, a plurality of heat-treated members each of which is the above wire-drawn member which has undergone heat treatment are twisted together to produce a stranded wire.

<Compression Step> The stranded wire is compression-molded into a predetermined shape to produce a compressed stranded wire.

When the <wire stranding step> and the <compression step> are comprised, the <heat treatment step> is performed to apply an aging and softening heat treatment to the stranded wire or the compressed stranded wire. When a stranded wire or compressed stranded wire of the above heat-treated member is provided, a second heat treatment step of further subjecting the stranded wire or the compressed stranded wire to an aging and softening treatment may be comprised or dispensed with. When the aging and softening treatment is performed a plurality of times, a heat treatment condition can be adjusted so that the above-described characteristics satisfy a specific range. By adjusting the heat treatment condition, for example it is easy to suppress growth of crystal grains to form a fine crystal structure, and it is easy to have high strength and high elongation.

(Covered Electrical Wire)

Manufacturing covered electrical wire 3, a covered electrical wire comprising copper alloy wire 1 in the form of a solid wire, and the like comprises a covering step to form an insulating covering layer to surround a copper alloy wire (copper alloy wire 1 of an embodiment) manufactured in the above-described copper alloy wire manufacturing method or a copper alloy stranded wire (copper alloy stranded wire 10 of an embodiment) manufactured in the above-described copper alloy stranded wire manufacturing method. The insulating covering layer can be formed in known methods such as extrusion-coating and powder-coating.

(Terminal-Equipped Electrical Wire)

Manufacturing terminal-equipped electrical wire 4 comprises a crimping step in which the insulating covering layer is removed at an end of a covered electrical wire that is manufactured in the above-described covered electrical wire manufacturing method (e.g., covered electrical wire 3 or the like of an embodiment) to expose a conductor and a terminal is attached to the exposed conductor.

Hereinafter, the casting step, the wire drawing step, and the heat treatment step will be described in detail.

<Casting Step>

In this step, a copper alloy having a specific composition including Ni, or Ni and Fe, and P in a specified range, as described above, is molten and continuously cast to prepare a cast material. Furthermore, the copper alloy may include the above-described Sn or the like in a specific range. Melting the copper alloy in a vacuum atmosphere can prevent oxidation of elements such as Ni, Fe and P, and Sn when Sn is contained. In contrast, doing so in an atmosphere of the air eliminates the necessity of controlling the atmosphere and can thus contribute to increased productivity. In that case, to suppress oxidation of the above elements by oxygen in the atmosphere, it is preferable to add the above-described deoxidizing elements (C, Mn, Si).

C (carbon) is added for example by covering the surface of the melt with charcoal chips, charcoal powder or the like. In that case, C can be supplied into the melt from charcoal chips, charcoal powder or the like in a vicinity of the surface of the melt.

Mn and Si may be added by separately preparing a source material including these elements, and mixing the source material into the melt. In that case, even if a portion of the melt exposed at the surface of the melt through gaps formed by the charcoal chips or charcoal powder comes into contact with oxygen in the atmosphere, the portion can be prevented from oxidation in the vicinity of the surface of the melt. Examples of the source material include Mn and Si as simple substances, Mn or Si and Fe alloyed together, and the like.

In addition to adding the above deoxidizing element, it is preferable to use a crucible, a mold or the like of a high-purity carbon material having few impurities, as doing so makes it difficult to introduce impurities into the melt.

Herein, copper alloy wire 1 of an embodiment representatively causes Ni, Fe and P to be present in a precipitated state, and Sn to be present in a state of a solid solution when Sn is contained. Therefore, it is preferable that copper alloy wire 1 is manufactured through a process comprising a process for forming a supersaturated solid solution. For example, a solution treatment step for performing a solution treatment can be separately provided. In that case, the supersaturated solid solution can be formed at any time. When continuous casting is performed with an increased cooling rate to prepare a cast material of a supersaturated solid solution, it is not necessary to separately provide a solution treatment step, and copper alloy wire 1 can be manufactured which finally has excellent electrical and mechanical properties and is thus suitable for a conductor for covered electrical wire 3 or the like. Accordingly, as a method for manufacturing copper alloy wire 1, it is proposed to perform continuous casting, and apply a large cooling rate to a cooling process to provide rapid cooling, in particular.

For continuous casting, various casting methods can be used such as a belt and wheel method, a twin belt method, an up-cast method and the like. In particular, the up-cast method is preferred because it can reduce impurities such as oxygen and facilitates suppressing oxidation of Cu, and Fe, P, Sn and the like. Casting is done preferably at rate of 0.5 m/min or more, even 1 m/min or more. The cooling rate in the cooling process is preferably higher than 5° C./sec, even higher than 10° C./sec, 15° C./sec or higher.

Various types of plastic working, cutting and other processing can be applied to the cast material. Plastic working includes conform extrusion, rolling (hot, warm, cold), and the like. Cutting includes stripping and the like. Thus working the cast material allows the cast material to have reduced surface defects, so that in wire drawing, breakage or the like can be reduced to contribute to increased productivity. In particular, when these workings are applied to an upcast material, the material becomes resistant to breakage.

<Wire Drawing Step>

In this step, the cast material (including the cast material having been worked as described above) undergoes at least one pass, representatively a plurality of passes, of wire-drawing (cold) to prepare a wire-drawn member having a final wire diameter. When a plurality of passes is applied, a degree of working for each pass may be appropriately adjusted depending on the composition, the final wire diameter, and the like. When wire drawing is preceded by an intermediate heat treatment, a plurality of passes and the like, the intermediate heat treatment can be performed between passes to enhance workability. The intermediate heat treatment can be done under a condition selected, as appropriate, so as to obtain desired workability.

<Heat Treatment Step>

In this step, the wire-drawn member undergoes a heat treatment that is an aging and softening treatment aimed at artificial aging and softening as described above. This aging and softening treatment allows the copper alloy to be such that a ratio of precipitation of P to solid solution of P therein is 1.1 or more, and can satisfactorily contemplate the strength enhancement effect provided through enhanced precipitation of precipitates or the like and the high conductivity maintaining effect provided through reduction of solid solution in Cu. Copper alloy wire 1, copper alloy stranded wire 10 and the like excellent in conductivity and strength can thus be obtained. In addition, the aging and softening treatment can improve elongation or the like while maintaining high strength, and copper alloy wire 1 and copper alloy stranded wire 10 also excellent in toughness can be obtained.

When the aging and softening treatment is performed for a batch process, it is performed under a condition for example as follows:

(Heat treatment temperature) 300° C. or higher and lower than 700° C., preferably 400° C. or higher and 600° C. or lower, even 500° C. or lower.

(Holding time) 4 hour or more and 40 hours or less, preferably 5 hours or more and 20 hours or less.

The holding time as referred to herein is a period of time for which the above heat treatment temperature is held, and it excludes a period of time for which temperature is raised and that for which temperature is lowered.

Selection may be made from the above ranges depending on the composition, the working state, and the like. Note that continuous processing such as a furnace type or an electrical conduction type may be used.

For a given composition, a heat treatment performed at high temperature within the above range tends to improve conductivity, elongation at fracture, impact resistance energy in a state with a terminal attached, and the main wire's impact resistance energy. When the above heat treatment temperature is low, it can suppress growth of crystal grains and also tends to improve tensile strength. When the above precipitate is sufficiently precipitated, high strength is provided, and in addition, conductivity tends to be improved. Further, higher heat treatment temperature and longer holding time help to precipitate P and tend to provide an improved ratio of precipitation of P to solid solution of P. Depending on the heat treatment's condition(s), the ratio of precipitation of P to solid solution of P can be 1.2 or more, 1.3 or more, 1.4 or more, even 1.5 or more.

In addition, an aging treatment can mainly be performed during wire-drawing, and a softening treatment can mainly be applied to a final stranded fire. The aging treatment and the softening treatment may be performed under conditions selected from the conditions of the aging and softening treatment described above.

A specific example of a process for manufacturing the copper alloy wire and the covered electrical wire is shown in Table 1.

see wire diameter (mm) shown in table 3). Each covered electrical wire was manufactured in a manufacturing pattern (b) shown in Table 1.

For any manufacturing pattern, the following cast material was prepared.

(Cast Material)

Electric copper (purity: 99.99% or higher) and a master alloy containing each element shown in Table 2 or the element in the form of a simple substance were prepared as a raw material. From the prepared raw material, a melt of a copper alloy was produced using a crucible made of high-purity carbon (with impurity in an amount of 20 ppm by mass or less). The copper alloy has a composition (with a balance being Cu and inevitable impurities) shown in Table 2.

The melt of the copper alloy and a high-purity carbon mold (with impurity in an amount of 20 ppm by mass or less) were used in an upcast method to perform continuous

TABLE 1

| copper alloy wire manufacturing patterns | | | covered electrical wire manufacturing patterns | | |
|---|---|---|---|---|---|
| (A) | (B) | (C) | (a) | (b) | (c) |
| continuous casting (wire diameter: φ8 mm-30 mm) | continuous casting (wire diameter: φ8 mm-30 mm) | continuous casting (wire diameter: φ8 mm-30 mm) | continuous casting (wire diameter: φ8 mm-30 mm) | continuous casting (wire diameter: φ8 mm-30 mm) | continuous casting (wire diameter: φ8 mm-30 mm) |
| ↓ | ↓ | ↓ | ↓ | ↓ | ↓ |
| conform extrusion (wire diameter: φ5 mm-10 mm) | cold rolling (wire diameter: φ5 mm-10 mm) | wire drawing (wire diameter: φ0.35 mm or φ0.16 mm) | conform extrusion (wire diameter: φ5 mm-10 mm) | cold rolling (wire diameter: φ5 mm-10 mm) | wire drawing (wire diameter: φ0.16 mm) |
| ↓ | ↓ | ↓ | ↓ | ↓ | ↓ |
| wire drawing (wire diameter: φ0.35 mm or φ0.16 mm) | stripping (wire diameter: φ4 mm-9 mm) | heat treatment (aging & softening) | wire drawing (wire diameter: φ0.16 mm) | stripping (wire diameter: φ4 mm-9 mm) | twisting 7 wires together → compressed stranded wire (cross section: 0.13 $mm^2$) |
| ↓ | ↓ | | ↓ | ↓ | ↓ |
| heat treatment (aging & softening) | wire drawing (wire diameter: φ0.35 mm or φ0.16 mm) | | twisting 7 wires together → compressed stranded wire (cross section: 0.13 $mm^2$) | wire drawing (wire diameter: φ0.16 mm) | neat treatment (aging & softening) |
| | ↓ | | ↓ | ↓ | ↓ |
| | heat treatment (aging & softening) | | heat treatment (aging & softening) | twisting 7 wires together → compressed stranded wire (cross section: 0.13 $mm^2$) | extruding insulating material (PVC or PP, thickness: 0.1 mm-0.3 mm) |
| | | | ↓ | ↓ | |
| | | | extruding insulating material (PVC or PP, thickness: 0.1 mm-0.3 mm) | neat treatment (aging & softening) | |
| | | | | ↓ | |
| | | | | extruding insulating material (PVC or PP, thickness: 0.1 mm-0.3 mm) | |

[Test Example 1]

Copper alloy wires of various compositions and covered electrical wires using the obtained copper alloy wires as conductors were manufactured under various manufacturing conditions and had their characteristics examined.

Each copper alloy wire was manufactured in a manufacturing pattern (B) shown in Table 1 (for final wire diameter, casting to prepare a cast material (wire diameter: φ12.5 mm) having a round cross section. The casting was done at a rate of 1 m/min and cooling was done at a rate higher than 10° C./sec.

(Copper Alloy Wire)

In the copper alloy wire manufacturing pattern (B), a wire-drawn member was subjected to a heat treatment at a heat treatment temperature indicated in Table 2, and thus held in the heat treatment for a period of time indicated in Table 2.

(Covered Electrical Wire)

In the covered electrical wire manufacturing pattern (b), a wire-drawn member having a wire diameter of φ0.16 mm was produced in the same manner as the process indicated in the copper alloy wire manufacturing pattern (B). Seven wire-drawn members were twisted together to produce a stranded wire. Thereafter, the stranded wire was compression-molded to prepare a compressed stranded wire having a transverse cross-sectional area of 0.13 $mm^2$ (0.13 sq), and the compressed stranded wire was subjected to heat treatment. The heat treatment was performed at a heat treatment temperature indicated in Table 2, and thus held for a period of time indicated in Table 2. Polyvinyl chloride (PVC) was extruded on the heat-treated member circumferentially to cover the member to form an insulating covering layer having a thickness of 2 mm. A covered electrical wire comprising the heat-treated member as a conductor was thus produced.

(Ratio of Precipitation of P to Solid Solution of P)

Copper alloy wires manufactured in manufacturing pattern (B) (φ0.35 mm or φ0.16 mm) were each subjected to XAS measurement and thus examined for a ratio of precipitation of P to solid solution of P in the copper alloy. A result is shown in Table 2.

XAS measurement was conducted as follows: a sample for measurement of a copper alloy wire was prepared, and the XAS beamline BL6N1 of the Aichi Synchrotron Radiation Center was employed to subject the sample to measurement of P K-edge XANES spectrum through partial fluorescence yield measurement. The sample was prepared by mechanically polishing and thus shaving a surface of the copper alloy wire by 10 μm or more. In partial fluorescence yield measurement, a semiconductor detector was used to measure intensity of fluorescent x-ray generated from P in the sample. As a spectroscope, a double-crystal monochromator of InSb (111) was used, and the measurement was conducted in an atmosphere of He under the atmospheric pressure. As has been described with reference to FIG. 4, the measured XAFS spectrum was analyzed with analysis software and normalized through the above analysis procedure. For normalization, $Ca_3(PO_4)_2$ was used as a standard sample. In the obtained XANES spectrum, a maximum value of x-ray absorption within a range along the horizontal axis from −8.0 eV to −7.0 eV and a minimum value of x-ray absorption within a range along the horizontal axis from −5.5 eV to −4.5 eV were read. The maximum value of x-ray absorption within the range from −8.0 eV to −7.0 eV was used as degree of precipitation $I_0$ and the minimum value of x-ray absorption within the range from −5.5 eV to −4.5 eV was used as degree of solid solution $I_1$, and a ratio of the two ($I_0/I_1$) was determined as a ratio of precipitation of P to solid solution of P. The XAS measurement may be done using the XAS beamline BL16 of the Kyushu Synchrotron Light Research Center, and it is also possible to determine a ratio of precipitation of P to solid solution of P from the measured XANES spectrum in a similar manner.

TABLE 2

| sample | composition (% by mass) | | | | | mass ratio | heat treatment conditions: heat treatment temperature | heat treatment conditions: holding time | ratio of precipitation of P to solid solution of P |
|---|---|---|---|---|---|---|---|---|---|
| No. | Cu | Ni | Fe | P | Sn | (Ni + Fe)/P | (° C.) | (h) | ($I_0/I_1$) |
| 1-1 | Bal. | 0.1 | 0.6 | 0.13 | 0.25 | 5.4 | 400 | 8 | 1.20 |
| 1-2 | Bal. | 0.1 | 0.6 | 0.13 | 0.25 | 5.4 | 460 | 8 | 1.67 |
| 1-3 | Bal. | 0.1 | 0.6 | 0.13 | 0.25 | 5.4 | 460 | 8 | 1.67 |
| 1-4 | Bal. | 0.8 | — | 0.2 | — | 4.0 | 440 | 8 | 1.58 |
| 1-5 | Bal. | 0.7 | — | 0.15 | — | 4.7 | 390 | 8 | 1.12 |
| 1-101 | Bal. | — | — | 0.2 | 6.0 | — | 500 | 3 | 1.00 |
| 1-102 | Bal. | — | — | 0.1 | — | — | 400 | 3 | 1.00 |

(Measurement of Characteristics)

Copper alloy wires manufactured in manufacturing pattern (B) (φ0.35 mm or φ0.16 mm) each had its tensile strength (MPa), elongation at fracture (%), conductivity (% IACS) and work hardening exponent examined. A result is shown in Table 3.

The conductivity (% IACS) was measured in a bridge method. The tensile strength (MPa), the elongation at fracture (%) and the work hardening exponent were measured using a general-purpose tensile tester according to JIS Z 2241 (Metallic materials-Tensile testing-Method, 1998).

Covered electrical wires manufactured in manufacturing pattern (b) (with a conductor having a cross-sectional area of 0.13 $mm^2$) each had its terminal fixing force (N) examined. In addition, compressed stranded wires manufactured in manufacturing pattern (b) were examined regarding the conductor's impact resistance energy in a state with a terminal attached (J/m, impact resistance E with terminal attached) and the conductor's impact resistance energy (J/m, impact resistance E). A result is shown in Table 3.

Figure 3:
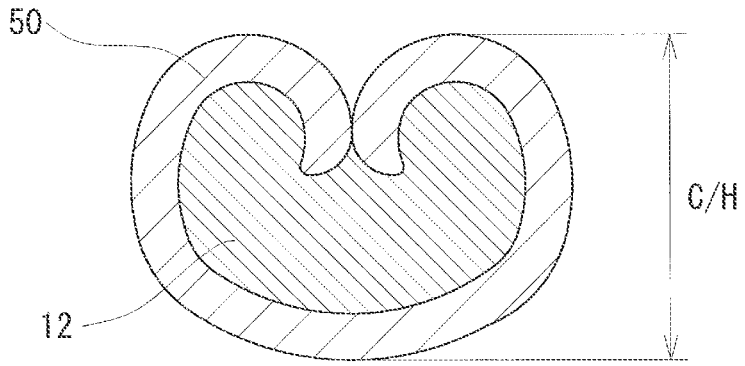
FIG. 3 is a transverse cross-sectional view of the FIG. 2 terminal-equipped electrical wire taken along a line (III)-(III).

Terminal fixing force (N) is measured as follows: At one end of the covered electrical wire, the insulating covering layer is stripped to expose a conductor that is the compressed stranded wire, and a terminal is attached to one end of the compressed stranded wire. Herein, the terminal is a commercially available crimp terminal and crimped to the compressed stranded wire. Furthermore, herein, as shown in FIG. 3, an attachment height (a crimp height C/H) was adjusted so that the conductor (or compressed stranded wire) at a terminal attachment portion 12 had a transverse cross-sectional area having a value shown in FIG. 3 relative to a transverse cross-sectional area of a portion of the main wire other than the terminal attachment portion (a remaining conductor ratio of 70% or 80%).

Using a general-purpose tensile tester, a maximum load (N) for which the terminal did not escape when the terminal was pulled by 100 mm/min was measured. This maximum load is defined as a terminal fixing force.

The conductor's impact resistance energy (J/m or (N/m)/m) is measured as follows: Before an insulating material is extruded, a weight is attached to a tip of a heat-treated member (i.e., a conductor composed of a compressed stranded wire), and the weight is lifted upward by 1 m, and then caused to freely fall. The weight's maximum gravitational weight (kg) for which the conductor does not break is measured, and the gravitational weight is multiplied by the gravitational acceleration (9.8 $m/s^2$) and the falling distance and divided by the falling distance to obtain a value (i.e., (weight's gravitational weight×9.8×1)/1), which is defined as the conductor's impact resistance energy.

Figure 5:
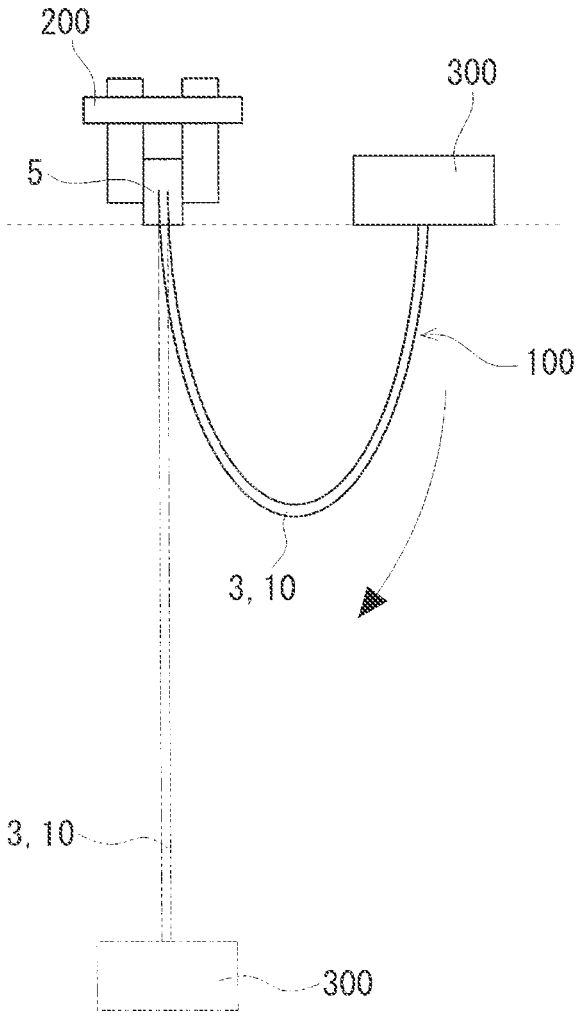
FIG. 5 illustrates a method for measuring impact resistance energy in a state with a terminal attached in a Test Example 1.

The conductor's impact resistance energy in a state with a terminal attached (J/m or (N/m)/m) is measured as follows: As has been done in measuring a terminal fixing force, as has been described above, before an insulating material is extruded, terminal 5 (herein, a crimp terminal) is attached to one end of conductor 10 of a heat-treated member (a conductor composed of a compressed stranded wire) to thus prepare a sample 100 (herein, having a length of 1 m), and terminal 5 is fixed by a jig 200 as shown in FIG. 5. A weight 300 is attached to the other end of sample 100 and lifted to the level at which terminal 5 is fixed, and then weight 300 is caused to freely fall. Similarly as done for the impact resistance energy of the conductor described above, a maximum gravitational weight of weight 300 for which conductor 10 does not fracture is measured, and ((the weight's gravitational weight×9.8×1)/1) is defined as an impact resistance energy in a state with the terminal attached.

more in a state with a terminal attached, and there are also samples having 2.5 J/m or more.

Covered electrical wires of sample Nos. 1-1 to 1-5 comprising such a conductor are expected to per se have high impact resistance energy and to have high impact resistance energy in a state with a terminal attached.

Further, sample Nos. 1-1 to 1-5 all have large elongation at fracture, and it can be seen that the samples have high strength, high toughness and high conductivity in a good balance. Quantitatively, the samples provide elongation at fracture of 5% or more, even 8% or more, and there are also samples providing 10% or more.

Further, sample Nos. 1-1 to 1-5 all present terminal fixing force of 45 N or more, even 50 N or more, and as they have large terminal fixing force, they are excellent in fixing a terminal.

In addition, sample Nos. 1-1 to 1-5 all have a work hardening exponent of 0.1 or more, even 0.12 or more, and there are also samples having a work hardening exponent of 0.15 or more, even 0.16 or more. These samples having a large work hardening exponent allow work hardening to effectively enhance strength.

A reason for having been able to obtain the above result is considered as follows: It is believed that comprising as a conductor a copper alloy wire composed of a copper alloy having a specific composition including Ni, or Ni and Fe, and P in the above specific ranges was able to enhance precipitation of Ni, Fe and P to provide satisfactorily effectively increased strength, and was able to reduce solid

TABLE 3

| | characteristics | | | | | | characteristics (0.13 $mm^2$) | | | | |
|---|---|---|---|---|---|---|---|---|---|---|---|
| sample Nos. | process | wire diameter (mm) | tensile strength (MPa) | elongation at fracture (%) | conductivity (% IACS) | work hardening exponent | process | remaining conductor ratio (%) | terminal fixing force (N) | impact resistance E in state with terminal attached (J/m) | impact resistance E (J/m) |
| 1-1 | B | 0.16 | 567 | 8 | 60 | 0.12 | b | 70 | 62 | 2.4 | 5.1 |
| 1-2 | B | 0.16 | 432 | 15 | 64 | 0.18 | b | 70 | 53 | 2.6 | 7.2 |
| 1-3 | B | 0.16 | 432 | 15 | 64 | 0.18 | b | 80 | 55 | 5.1 | 7.2 |
| 1-4 | B | 0.16 | 427 | 16 | 72 | 0.18 | b | 70 | 54 | 3.1 | 7.5 |
| 1-5 | B | 0.16 | 474 | 10 | 71 | 0.16 | b | 70 | 58 | 2.5 | 6.4 |
| 1-101 | B | 0.35 | 408 | 61 | 17 | 0.44 | b | 70 | 44 | 1.8 | 22.4 |
| 1-102 | B | 0.35 | 250 | 42 | 75 | 0.35 | b | 70 | 30 | 0.8 | 10.1 |

As shown in Table 3, it can be seen that sample Nos. 1-1 to 1-5 all have conductivity, strength and impact resistance in a better balance than sample Nos. 1-101 and 1-102. Further, it can be seen that sample Nos. 1-1 to 1-5 are also all excellent in impact resistance in a state with a terminal attached. Quantitatively, they are as follows:

Sample Nos. 1-1 to 1-5 all have tensile strength of 385 MPa or more, even 420 MPa or more, and there are also samples having 430 MPa or more.

Sample Nos. 1-1 to 1-5 all have conductivity of 60% IACS or more, and there are also samples having 62% IACS or more, even 64% IACS or more.

Sample Nos. 1-1 to 1-5 all have a conductor having impact resistance energy of 4 J/m or more, even 5 J/m or more, and there are also samples having 6 J/m or more, even 7 J/m or more.

Sample Nos. 1-1 to 1-5 all have a conductor having impact resistance energy of 1.5 J/m or more, even 2 J/m or solution of P or the like to satisfactorily effectively maintain high conductivity of Cu. In particular, it is believed that as a ratio of precipitation of P to solid solution of P in the copper alloy is 1.1 or more, and a ratio of P present in the copper alloy in a precipitated state is thus relatively large, the strength enhancement effect provided through enhanced precipitation and the high conductivity maintaining effect provided through reduction of solid solution in Cu are further enhanced. Furthermore, it is believed that the above specific composition and appropriate heat treatment were able to prevent coarsening of crystal and excessive softening while obtaining an effect of enhanced precipitation of Ni, Fe and P and reduction of solid solution in Cu, and thus while large strength and high conductivity were achieved, elongation at fracture was also large and toughness was also excellent. Further, it is believed that being also excellent in toughness while high in strength enables being resistant to fracture against impact and thus excellent in impact resistance. Herein, it is believed that a ratio in mass of (Ni+Fe)/P)

set to 3 or more, even 4 or more, to include Ni, or Ni and Fe more than P was able to help Ni, or Ni and Fe to form a compound with P, as appropriate, to more suppress reduction in conductivity attributed to otherwise excessive P forming a solid solution in Cu.

In addition, it is believed that one reason for large impact resistance energy in a state with a terminal attached is that a work hardening exponent of 0.1 or more allowed work-hardening to provide a strength enhancement effect. For example, let us compare sample Nos. 1-1 and 1-2 having different work hardening exponents and identical conditions for attaching a terminal (or equal remaining conductor ratios). While sample No. 1-2 is lower in tensile strength than sample No. 1-1, the former has a larger impact resistance energy in a state with the terminal attached than the latter. It is believed that this is because sample No. 1-2 compensates for the small tensile strength by work hardening. In this test, when noting a relationship between tensile strength and terminal fixing force, it can be said that terminal fixing force tends to increase as tensile strength increases, and there is a correlation therebetween.

This test has indicated that applying plastic-working such as wire-drawing and a heat treatment such as an aging and softening treatment to a copper alloy having a specific composition including Ni, or Ni and Fe, and P can provide a copper alloy wire and a copper alloy stranded wire excellent in conductivity and strength, as described above, and in addition, also excellent in impact resistance, and a covered electrical wire and a terminal-equipped electrical wire using the copper alloy wire and the copper alloy stranded wire as a conductor. In addition, it can be seen that even the same composition can be varied in ratio of precipitation of P to solid solution of P, tensile strength, conductivity, impact resistance energy and the like by heat treatment temperature (for example, see comparison between sample Nos. 1-1 and 1-2). Increasing a heat treatment temperature tends to increase a ratio of precipitation of P to solid solution of P, conductivity and elongation at fracture, and the conductor's impact resistance energy.

REFERENCE SIGNS LIST

1 copper alloy wire
10 copper alloy stranded wire (conductor)
12 terminal attachment portion
2 insulating coating layer
3 covered electrical wire
4 terminal-equipped electrical wire
5 terminal
50 wire barrel portion
52 fitting portion
54 insulation barrel portion
100 sample
200 jig
300 weight

The invention claimed is:

1. A covered electrical wire comprising a conductor and an insulating covering layer provided outside the conductor, the conductor being a stranded wire composed of a plurality of copper alloy wires composed of a copper alloy and twisted together, and having a wire diameter of 0.5 mm or less, the copper alloy containing Ni, or Ni and Fe in an amount of 0.1% by mass or more and 1.6% by mass or less in total, and P in an amount of 0.05% by mass or more and 0.7% by mass or less, with a balance being Cu and impurities, in the copper alloy, a ratio of precipitation of P to solid solution of P being 1.1 or more.

2. The covered electrical wire according to claim 1, wherein the copper alloy includes Sn in an amount of 0.05% by mass or more and 0.7% by mass or less.

3. The covered electrical wire according to claim 1, wherein a ratio in mass of a total amount of Ni and Fe to a P content is 3 or more.

4. The covered electrical wire according to claim 1, wherein the copper alloy includes one or more elements selected from C, Si, and Mn in an amount of 10 ppm by mass or more and 500 ppm by mass or less in total.

5. The covered electrical wire according to claim 1, wherein the copper alloy wire has a tensile strength of 385 MPa or more.

6. The covered electrical wire according to claim 1, wherein the copper alloy wire provides an elongation at fracture of 5% or more.

7. The covered electrical wire according to claim 1, wherein the copper alloy wire has a conductivity of 60% IACS or more.

8. The covered electrical wire according to claim 1, wherein the copper alloy wire has a work hardening exponent of 0.1 or more.

9. The covered electrical wire according to claim 1, having a terminal fixing force of 45 N or more.

10. The covered electrical wire according to claim 1, having an impact resistance energy of 3 J/m or more in a state with a terminal attached to the covered electrical wire.

11. The covered electrical wire according to claim 1, having an impact resistance energy of 6 J/m or more.

12. A terminal-equipped electrical wire comprising a covered electrical wire according to claim 1 and a terminal attached to an end of the covered electrical wire.

13. A copper alloy wire composed of a copper alloy containing

Ni, or Ni and Fe in an amount of 0.1% by mass or more and 1.6% by mass or less in total, and P in an amount of 0.05% by mass or more and 0.7% by mass or less, with a balance being Cu and impurities, in the copper alloy, a ratio of precipitation of P to solid solution of P being 1.1 or more, and having a wire diameter of 0.5 mm or less.

14. A copper alloy stranded wire formed of a plurality of copper alloy wires, each according to claim 13, twisted together.

15. The copper alloy stranded wire according to claim 14, having an impact resistance energy of 1.5 J/m or more in a state with a terminal attached to the copper alloy stranded wire.

16. The copper alloy stranded wire according to claim 14, having an impact resistance energy of 4 J/m or more.

* * * * *